United States Patent [19]

Weinberger

[11] Patent Number: 4,522,298

[45] Date of Patent: Jun. 11, 1985

[54] COFFEE FILTER PACKAGE ARRANGEMENT

[75] Inventor: Royal Weinberger, Clifton, N.J.

[73] Assignee: North American Systems, Inc., Bedford Heights, Ohio

[21] Appl. No.: 627,049

[22] Filed: Jul. 2, 1984

[51] Int. Cl.[3] ..... B65D 79/00; B65D 21/00; B65D 85/62

[52] U.S. Cl. ..... 206/216; 206/445; 206/499; 206/526; 220/23; 220/406

[58] Field of Search ..... 206/216, 217, 526, 499, 206/445, 501, 449; 220/23, 406

[56] References Cited

U.S. PATENT DOCUMENTS

| | | | |
|---|---|---|---|
| 1,202,642 | 10/1916 | Allen | 206/217 |
| 1,947,835 | 2/1934 | Bubbs | 220/406 |
| 2,112,959 | 4/1938 | Harvey | 206/499 |
| 3,039,601 | 6/1962 | Martin | 220/23 |
| 3,417,895 | 12/1968 | Penton | 220/23 |
| 3,662,913 | 5/1972 | Mascia | 220/23 |
| 3,746,158 | 7/1973 | Connick | 220/23 |
| 3,822,013 | 7/1974 | Van der Veken | 206/501 |
| 4,266,665 | 5/1981 | Nelson | 206/526 |
| 4,362,623 | 12/1982 | Holopainen | 206/499 |

*Primary Examiner*—William T. Dixson, Jr.
*Attorney, Agent, or Firm*—Yount & Tarolli

[57] ABSTRACT

A coffee filter package which can be commercially distributed on top of a coffee can and retains a supply of nested coffee filters therein. The coffee filters are subsequently utilized by the consumer for filter dispensing. The package includes a cylindrical upper receptacle portion for receiving the supply of filters and retaining them in a compacted, pleated form. A peripheral skirt portion depends from the lower end of the receptacle for snapping onto the lid of the coffee can.

12 Claims, 8 Drawing Figures

COFFEE FILTER PACKAGE ARRANGEMENT

BACKGROUND OF THE INVENTION

This invention relates to coffee filter packages, and more particularly to a package which can be commercially distributed directly on a coffee can and subsequently utilized by a consumer for individual filter dispensing.

In the preparation of brewed coffee, ground coffee beans are generally purchased in a coffee can for use in a coffee maker. In the coffee maker, the coffee is placed in a filter basket with a porous paper filter lining the basket. Boiling water is passed through the coffee beans and drips into a coffee pot. The coffee beans are retained in the porous filter which is then disposed of. Each time a new pot of coffee is made, a new paper filter must be placed in the filter basket. Accordingly, a stack of paper filters are required for use in coffee makers to brew coffee.

The coffee filters are usually sold separate from the coffee and are retained in a separate package. This often is inconvenient since both the coffee container as well as the separate package of the coffee filters must always be used. Accordingly, it would be more appropriate if there could be provided integral packaging for both the coffee and the coffee filters since both are necessary for each pot of brewed coffee.

SUMMARY OF THE INVENTION

Accordingly, it is an object of the present invention to provide a suitable coffee filter package which avoids the aforementioned problems of prior art devices.

Another object of the present invention is to provide a coffee filter package which can be integrally assembled with a can of coffee to facilitate preparation of brewed coffee by requiring the selection of only a single composite package.

Another object of the present invention is to provide a coffee filter package which can be commercially distributed on the top of a coffee can, and can subsequently be utilized by a consumer for filter dispensing of individual coffee filters.

Another object of the present invention is to provide a coffee filter package which serves to retain a supply of nested coffee filters compactly secured in a pleated form while permitting individual dispensing of the coffee filters from the nested pack.

Yet a further object of the present invention is to provide a coffee filter package which can be integrally assembled with a coffee can and can be easily placed onto the top of the coffee can for the dispensing of individual coffee filters.

A further object of the present invention is to provide a coffee filter package permitting viewing of the coffee filters contained in the package, wherein the package sits onto a coffee can for easy storage thereof.

Briefly, in accordance with the present invention, there is provided a coffee filter package which includes a cylindrical upper receptacle portion for receiving a supply of nested coffee filters and retaining them in compacted pleated form. A peripheral skirt portion depends from the lower end of the receptacle portion for snapping onto the lid of a coffee can. Inwardly directed resilient locking tabs removably secure the filter package onto the coffee lid. In this manner, the package together with filters can be commercially distributed assembled on the top of a coffee can. Subsequently, the package can be utilized by a consumer for filter dispensing. The consumer can easily replace the package onto the coffee can and maintain the filter package assembled with the coffee can for easy access each time a pot of coffee is to be brewed.

BRIEF DESCRIPTION OF THE DRAWINGS

In the drawings.

In the various figures of the drawing, like reference characters designate like parts.

DESCRIPTION OF THE PREFERRED EMBODIMENT

Figure 1:
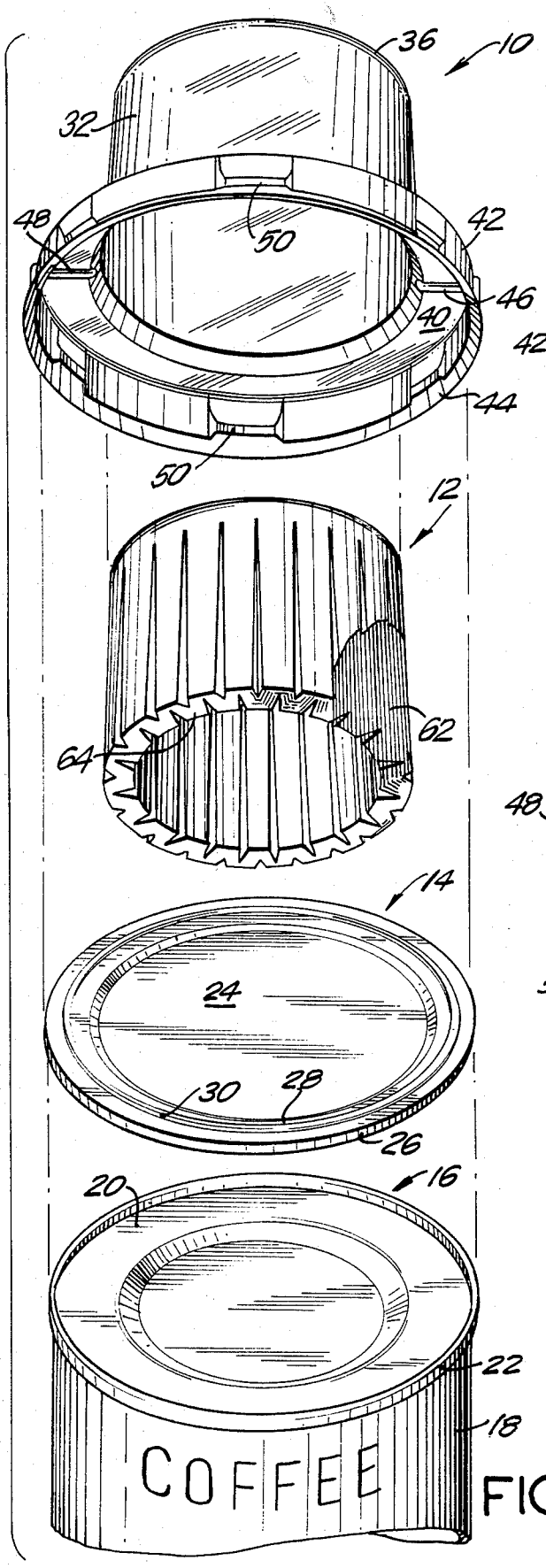
FIG. 1 is an exploded perspective view of the coffee filter package which receives a supply of nested coffee filters and is assembled onto the top of a coffee lid which fits on a can of coffee.

Referring now to FIG. 1, the coffee filter package of the present invention is shown generally at 10 and is available for storing a stack of nested coffee filters 12 and retains them in a compacted pleated form. The coffee filter package, together with the coffee filters retained therein can then be snap fitted onto lid 14 which is generally provided on top of a can of coffee 16.

More specfically, the can of coffee is usually formed of cylindrical metal material 18 having a metal can top 20. In normal procedures the coffee can is sold with an additional lid 14 so that after the coffee can top 20 is removed, the coffee lid 14 can be used to close the coffee can. For this purpose, a rib 22 is usually provided about the periphery of the coffee can to retain the lid in place.

The lid 14 includes an upper flat surface 24 with a downwardly directed peripheral skirt portion 26. The lid may typically include a raised annular border 28 and may also include an upwardly directed lip 30. There may also be included an inwardly directed lip inside of the skirt portion 26 to aid in grasping onto the top of the coffee can after the coffee top has been removed.

Figure 2:
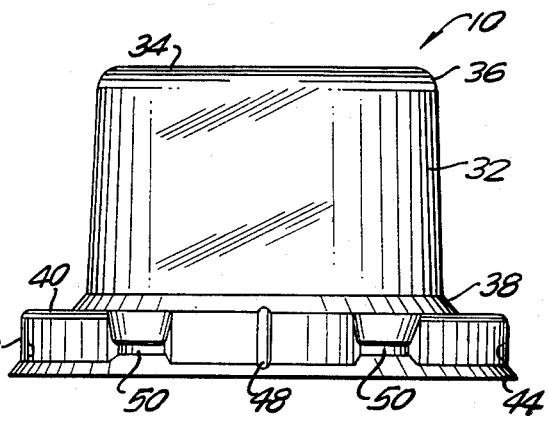
FIG. 2 is an elevational view of the coffee filter package shown in FIG. 1.
Figure 3:
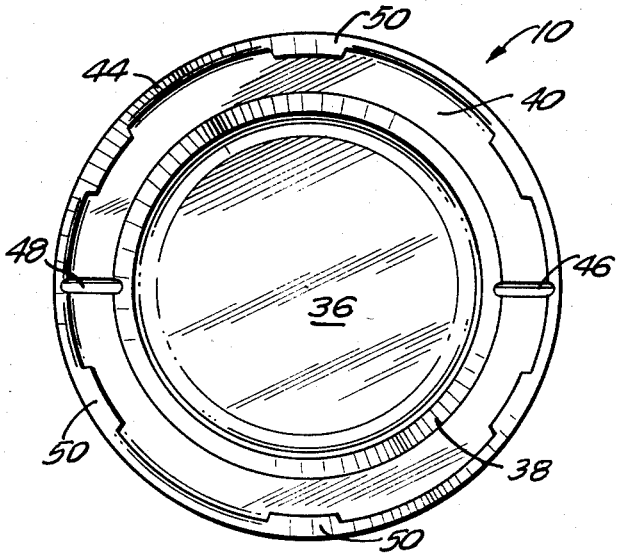
FIG. 3 is a bottom view of the coffee filter package shown in FIG. 1.

Referring now to FIGS. 1–3, the coffee filter package 10 includes an upper cylindrical receptacle 32 having a substantially flattened top portion 34 with a rounded edges 36. The lower end of the cylindrical receptacle terminates in an outwardly flared portion 38 interconnecting to a radially outwardly directed flange 40. The peripheral edge of the flange 40 continues into a downwardly directed skirt portion 42. The distal end of the skirt portion flares outwardly at 44 so as to define a wider mouth which will pilot the lid into the mouth portion. A pair of diametrically opposing stiffening ribs 46, 48 radially extend across the flange 42 to provide increased strength to the flange.

Figure 4:
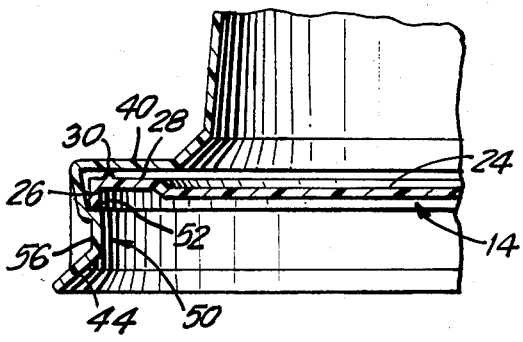
FIG. 4 is a partially broken away cross sectional view taken through the coffee filter package shown in FIG. 1 when assembled onto a coffee lid.

A plurality of inwardly directed resilient locking tabs 50 are spaced about the skirt portion. The locking tabs 50 include an elongated peripheral section of the skirt portion which is caused to project inwardly by deformation of the skirt portion. As best seen in FIG. 4, the locking tabs include an upper shoulder portion 52 and the lower flared portion 44 with intermediate vertical section 56. The spacing between the radial flange 40 and the upper shoulder 50 is dimensioned to accommodate the skirt of the coffee lid so as to eliminate any axial play between the package and the coffee lid. Although six such locking tabs are shown, any number can be included which will retain the package secure onto the coffee lid.

Figure 5:
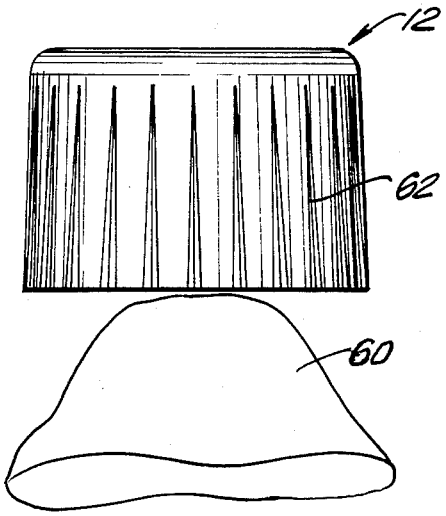
FIG. 5 is an elevational view showing the dispensing of a filter from the stack of nested coffee filters.

The coffee filter stack 12 is of substantially standard configuration as is well known in the art. As best seen in FIG. 5, the stack includes a plurality of individual paper porous filters 60 which are nested together to define a single compact stack 12. In its compact form, a plurality of pleats 62 are defined in the peripheral wall of the stack of filters and the bottom of the stack terminates in a wave pattern 64. The cylindrical receptacle 32 of the filter package 10 is dimensioned so as to compactly receive the stack of nested coffee filters and tightly retain there in place. However, the stack of filters can be removed so that individual filters can be dispensed one at a time. If desired, a drop of moisture can be placed in the cylindrical upper receptacle to retain the nested coffee filters in a substantially moist condition for use, and facilitate dispensing of the filters.

Figure 6:
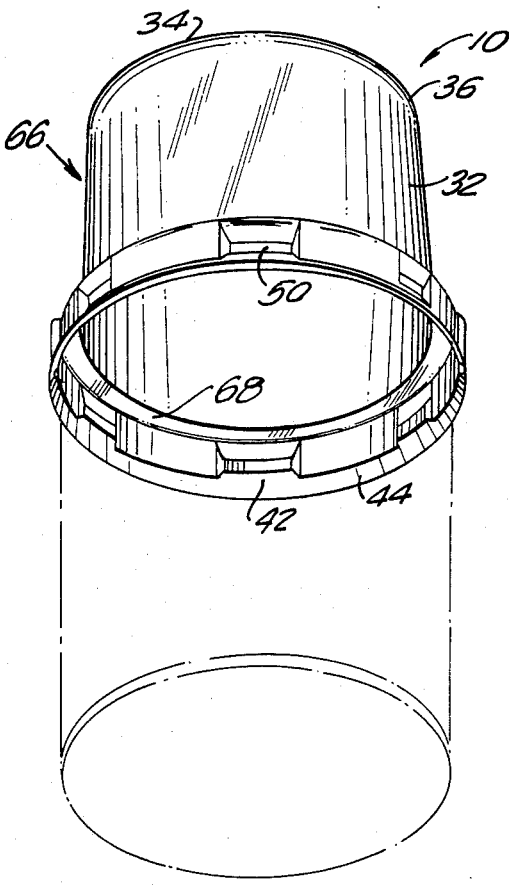
FIG. 6 is a perspective view of another embodiment of the coffee filter package for use with a smaller can of coffee.
Figure 7:
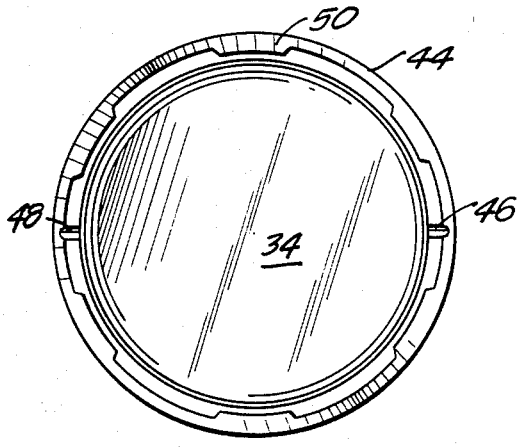
FIG. 7 is a bottom view of the coffee filter package shown in FIG. 6.
Figure 8:
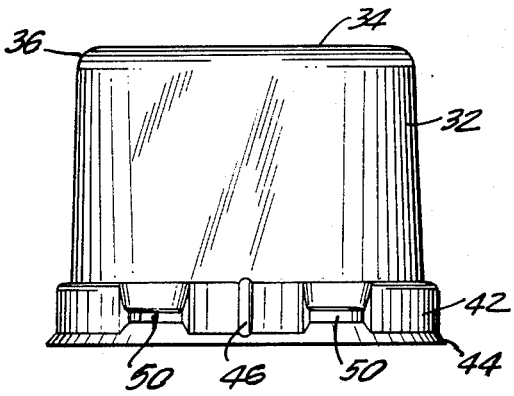
FIG. 8 is an elevational view of the coffee filter package shown in FIG. 6.

As shown in FIGS. 6–8, there is provided a second embodiment 66 of a coffee filter package. This embodiment is substantially similar to that shown in FIG. 1 and like parts are similarly identified. The coffee filter 66, however, is for use on a coffee can having a smaller diameter. In this case, a shorter flange portion 68 is provided intermediate between the cylindrical upper receptacle portion 10 and the skirt portion 42. Likewise, the flaring section 38 can be eliminated.

In use, the filter package will be packed with the nested coffee filters and securely placed on top of the coffee lid which sits on the coffee can. The coffee can with the assembled filter package will then be commercially distributed through sale, and the like. When the consumer brings home the assembled coffee can, he normally removes the top of the coffee can and utilizes the lid in place thereof. The filter package will remain on the lid and be available for use. Whenever a coffee filter is desired, the filter package can be removed from the lid, the stack of filters taken out of the package and an individual coffee filter dispensed for use in the coffee maker.

The filter package can be integrally formed of plastic material through molding or the like. It can be made of transparent material so the consumer can see the amount of filters available in the package. Even after the coffee is used up, the filter package can be removed from one can and placed onto another can so that the filters can be continuously utilized even after completion of the individual coffee can on which it was initially placed. Of course, should the individual not be buying any, the filter package could still be retained by itself with the coffee lid serving as the cover of the filter package, independent of the coffee can itself.

There has been disclosed heretofore the best embodiment of the invention presently contemplated. However, it is to be understood that various changes and modifications may be made thereto without departing from the spirit of the invention.

I claim:

1. A coffee filter package comprising:
   a cylindrical upper receptacle portion for receiving a supply of nested coffee filters and retaining them in pleated form;
   a peripheral skirt portion depending from the lower end of the receptacle portion for snapping onto the lid of a coffee can, and
   inwardly directed resilient locking tabs for removably securing the filter package onto the coffee lid, whereby said package with filters can be commercially distributed on the top of a coffee can and subsequently utilized by a consumer for filter dispensing.

2. A coffee filter package as in claim 1, wherein the distal edge of said skirt portion is radially outwardly directed to pilot the package onto the lid.

3. A coffee filter package as in claim 1, and comprising a radial flange intermediate the lower end of the receptacle portion and the skirt portion, the spacing between said locking tabs and said flange being dimensioned to eliminate axial play between the package and the lid.

4. A coffee filter package as in claim 1, wherein said locking tabs are inwardly directed projections defined into the skirt portion.

5. A coffee filter package as in claim 1, wherein said coffee filter is integrally formed of plastic material.

6. A coffee filter package as in claim 5, wherein said plastic material is transparent.

7. A coffee filter package as in claim 1, and comprising at least one pair of diametrically opposed stiffening ribs provided in said skirt portion.

8. In combination, a coffee can and coffee filter package, comprising:
   a cylindrical coffee can having a sealed top;
   a removable lid on the coffee can for covering the can after disposal of the sealed top; and
   a removable coffee filter package provided onto said coffee can the package including a cylindrical upper receptacle portion for housing a supply of nested coffee filters, and a peripheral skirt portion depending from the receptacle portion for removably snapping onto the lid.

9. The combination as in claim 8, wherein said receptacle portion is dimensioned to maintain the nested coffee filters in a compact, upstanding, pleated stack of filters, permitting individual filter to be dispensed therefrom.

10. The combination as in claim 8, and comprising a plurality of resilient locking tabs inwardly projecting from the skirt portion for removably securing the filter package onto the coffee lid.

11. The combination as in claim 8, wherein the distal edge of said skirt portion is radially outwardly directed to pilot the package onto the lid.

12. The combination as in claim 10, and comprising a radial flange intermediate the lower end of the receptacle portion and the skirt portion, the spacing between said locking tabs and said flange being dimensioned to eliminate axial play between the package and the lid.

* * * * *